United States Patent [19]

Barthel

[11] Patent Number: 4,481,779

[45] Date of Patent: Nov. 13, 1984

[54] CRYOGENIC STORAGE CONTAINER

[75] Inventor: Alfred Barthel, Indianapolis, Ind.

[73] Assignee: Union Carbide Corporation, Danbury, Conn.

[21] Appl. No.: 506,811

[22] Filed: Jun. 22, 1983

[51] Int. Cl.[3] ..... F17C 11/00

[52] U.S. Cl. ..... 62/48; 62/514 R; 220/421; 220/424

[58] Field of Search ..... 62/45, 48, 514 R, 385; 220/420, 421, 422, 423, 424, 425

[56] References Cited

U.S. PATENT DOCUMENTS

| | | | |
|---|---|---|---|
| 727,609 | 5/1903 | Fouche' | 62/48 |
| 1,903,171 | 3/1933 | Cordrey | 62/385 |
| 2,662,379 | 12/1953 | Reich | 62/48 |
| 2,883,040 | 4/1959 | Pater et al. | 206/0.7 |
| 2,892,563 | 6/1959 | Morrison | 220/15 |
| 2,948,123 | 8/1960 | Morrison | 62/457 |
| 3,029,967 | 4/1962 | Morrison | 220/9 |
| 3,074,586 | 1/1963 | Morrison | 220/9 |
| 3,160,307 | 12/1964 | Morrison | 220/9 |
| 3,238,002 | 3/1966 | O'Connell et al. | 62/48 |
| 3,309,893 | 3/1967 | Heffler et al. | 62/457 |
| 4,129,450 | 12/1978 | Flanigen | 106/120 |
| 4,154,363 | 5/1979 | Barthel | 220/421 |

FOREIGN PATENT DOCUMENTS 5214210 7/1975 Japan .

OTHER PUBLICATIONS

Johns-Manville-Insulation Product Literature-1. -Scored Block Insulation, 12/1980.
2. -Pipe & Block Insulation, 12/1980.

*Primary Examiner*—Ronald C. Capossela
*Attorney, Agent, or Firm*—Eugene Lieberstein

[57] ABSTRACT

A storage container for shipping transportable materials at cryogenic temperatures including a vessel which opens to the atmosphere and contains a micro-fibrous structure for holding a liquified gas such as liquid nitrogen in adsorption and capillary suspension. The micro-fibrous structure comprises a core permeable to liquid and gaseous nitrogen and an adsorption matrix composed of a web of inorganic fibers surrounding the core in a multi-layered arrangement.

15 Claims, 2 Drawing Figures

CRYOGENIC STORAGE CONTAINER

This invention relates to open to atmosphere storage containers for storing bio-systems at cryogenic temperatures and more particularly to an open to atmosphere shipping container adapted to hold a supply of liquid nitrogen for refrigerating a stored biological product during transportation from one location to another over a relatively long time period.

BACKGROUND OF THIS INVENTION

The shipment of heat-sensitive bio-systems, as for instance semen, vaccines, cultures of bacteria and viruses at optimal temperature levels between about 78 K. and 100 K., poses a series of difficulties. The vials or "straws", in which the biologicals are hermetically sealed, must be kept continuously at near liquid nitrogen temperature to preserve the viability of the biological product. But since the boiling point of liquid nitrogen at ambient pressure is 77.4 K. (−320.4° F.) the cryogen holding vessel (refrigerator) must remain open to the atmosphere to vent the boiled-off gas and thus avoid a dangerous pressure build-up inside. For this reason open-to-atmosphere liquid nitrogen vessels are used for refrigeration. It is obvious that such vessels must be kept upright at all times to prevent spillage of the cryogen. This condition is difficult to control during a long shipment unless an attendant accompanies the vessel on the trip which is rarely a feasible option.

To overcome the difficulties associated with the shipment of biologicals at cryogenic temperature a shipping container was developed in which the liquid nitrogen is retained in a solid porous mass by adsorption, capillarity and absorption. Based upon this development a patent issued to R. F. O'Connell et al. in 1966 as U.S. Pat. No. 3,238,002. The shipping container described in this patent is of a double-walled construction to provide a vacuum space around the inner vessel which holds the liquid nitrogen. The vacuum space is filled with a multilayer insulation to reduce heat transfer by radiation. An adsorbent and a getter are part of the system to maintain vacuum integrity. The inner vessel is filled with the solid porous mass which, when saturated with liquid nitrogen, will hold the cryogen by adsorption, and capillarity as well as by absorption, similar to a sponge "holding" water. In the center of the porous filler core one or more voids are provided to hold the vials containing the biologicals.

The solid components of the porous mass described in U.S. Pat. No. 3,238,003 are silica (sand), quick-lime, and a small amount of inert heat resistant mineral fibers such as asbestos. The porous mass is formed starting with an aqueous slurry of the filler components which is poured into a mold and then baked in an autoclave under precisely controlled equilibrium conditions of pressure and temperature. The components undergo a chemical reaction forming a porous mass of calcium silicates, reinforced by inert fibers. The evaported water leaves inside the dried out solid structure microscopic voids, of complex geometry, sometimes referred to as "pores", which comprise on the average 89.5% of the apparent solid volume. Since the resulting mass is incompressible the mold must either provide the mass with a shape conforming to the inner vessel of the storage container or it must be machined to size. The porous mass is filled with liquid nitrogen by submerging it in a liquid nitrogen bath until it is saturated. The filling operation for a conventional two liter container housing a sand-lime porous mass matrix takes about twenty-four hours.

The baked sand-lime porous mass is intrinsically hydrophilic. Because of this property moisture must be periodically driven out of the porous mass matrix to prevent the accumulation of trapped water. If this is not done, the trapped water will turn into ice crystals every time it is exposed to liquid nitrogen and eventually will crack the brittle microstructure of the filler. This may be prevented by periodically heating the porous structure to above 100° C. after several fill and warm up cycles.

Although the ingredients used in manufacturing the sand-lime porous mass are relatively inexpensive (deionized water, sand, quick-lime and inert fibers, as for example asbestos) the finishing operations in handling a solid porous mass are very expensive due to the high labor costs involved and the elaborate safety precaustions required. It is not economically feasible to cast the porous filler in a cryogenic holding vessel. Elaborate safety precautions are indispensable when handling substances like asbestos fibers and noxious dust. In addition, the thermal energy cost is very high for the manufacturing process of the sand-lime filler mass.

Alternative systems for retaining liquid nitrogen in a storage container through a combination of adsorption, absorption and capillarity have in the past being investigated by those skilled in the art. The use of high porosity blocks, artificial stones, bricks and light papers made from cellulose fibers such as towels and bathroom tissues have been studied and, in general have been dismissed as inferior compared to the use of the sand-lime porous mass matrix due primarily to their low porosity. The average porosity of the sand-lime porous matrix is 89.5% whereas the porosity of a matrix fabricated from any of the aforementioned materials is below 60%. More recently block insulation material composed of hydrous calcium silicate has been used as the adsorption matrix. Such material is closer in porosity to the sand-lime porous mass composition but also has most of the shortcomings of the sand-lime porous mass composition. The porosity of the filler matrix determines for a given size shipping container its liquid nitrogen capacity. The porosity and rate of evaporation are the most important characteristics of a liquid nitrogen storage container for transporting a product at cryogenic temperatures. A storage container using a sand-lime porous mass matrix has an average 5 day holding time based on an evaporation rate of 0.33 liters per day and a liquid capacity of 1.6 liters.

Accordingly, the art has long sought a less expensive and much more efficient liquid nitrogen adsorption system as an alternative to the storage systems in present use.

OBJECTS OF THE INVENTION

It is therefore, the principle object of the present invention to provide a low cost refrigerated storage container for transporting bio-systems at cryogenic temperatures.

It is another object of the present invention to provide a refrigerated storage container for shipping a bio-system over a long holding period during which time the bio-system is sustained in suspended animation at cryogenic temperatures.

It is yet another object of the present invention to provide a low cost refrigerated storage container having a liquid nitrogen adsorption matrix which has a high average holding capacity and is intrinsically hydrophobic.

A still further object of the present invention is to provide a refrigerated storage container having a liquid nitrogen adsorption matrix which has a higher adsorptivity than state of the art liquid nitrogen adsorption matrices and which will fill to capacity in a substantially reduced time period.

BRIEF DESCRIPTION OF THE DRAWINGS

Further objects and advantages of the present invention will become apparent from the following detailed description of the invention when read in conjunction with the accompanying drawings of which.

SUMMARY OF THE INVENTION

The storage container of the present invention includes a vessel which opens to the atmosphere and contains a micro fibrous structure for holding a liquified gas such as liquid nitrogen in adsorption and capillary suspension. The microfibrous structure broadly comprises a core permeable to liquid and gaseous nitrogen having a cavity extending therethrough which is adapted for the removable placement of a product to be transported at cryogenic temperatures and a liquid nitrogen adsorption matrix composed of a web of inorganic fibers of e.g. glass or quartz or a ceramic of very small diameters surrounding the core in a multilayered arrangement preferably in the form of a coiled roll having a multiplicity of layers and an outside diameter conforming to the inside diameter of the vessel. The core is preferably tubular with the hollow center used as the storage cavity for receiving the transportable product. The storage container is preferably of a double walled construction to provide a vacuum space between the inner and outer walls with the inner wall defining the liquid nitrogen holding vessel. The vacuum space is filled with insulation preferably multilayer insulation consisting of e.g. low emissivity radiation barriers interleaved with low heat conducting spacers.

DESCRIPTION OF THE PREFERRED EMBODIMENT

Figure 1:
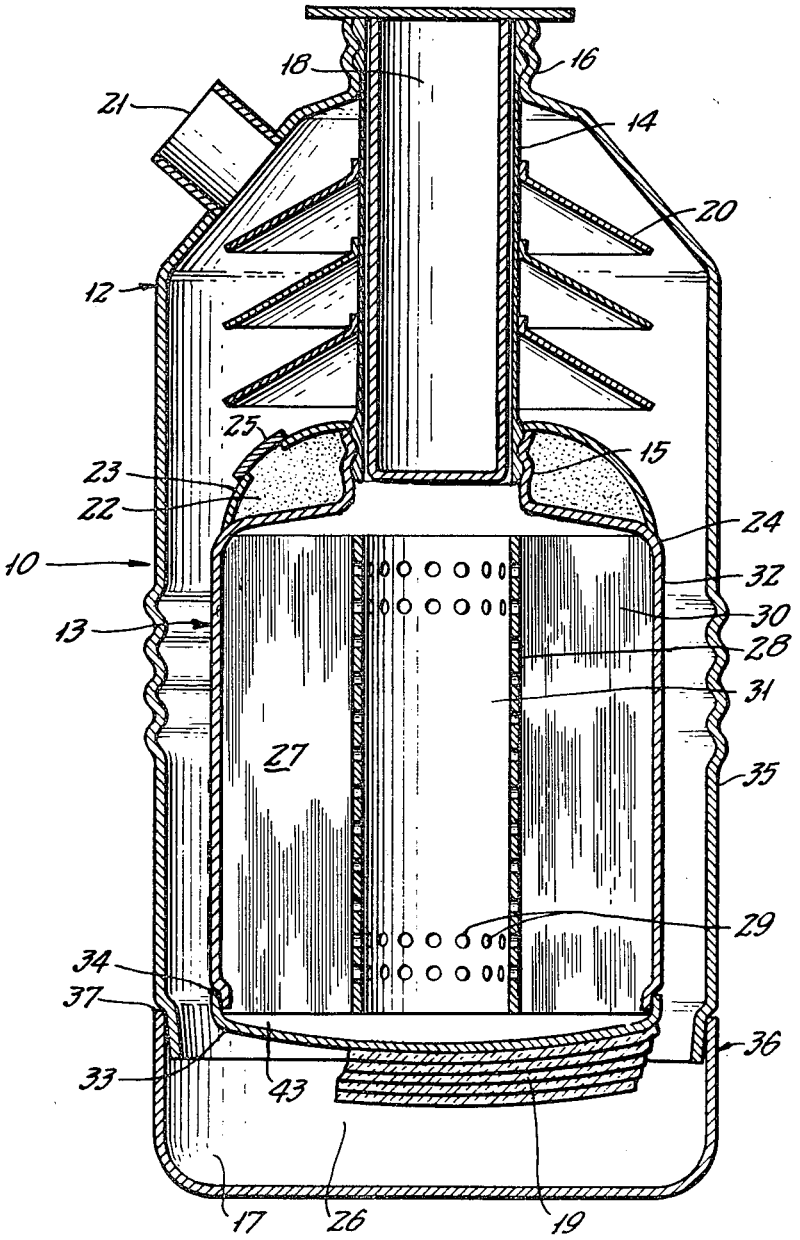
FIG. 1 is a front elevational view, in section, of the storage container of the present invention.

The invention is illustrated in the preferred embodiment of FIG. 1 which shows a storage container 10 having a self supporting outer shell 12 surrounding an inner vessel 13. The inner vessel 13 is suspended from the outer shell 12 by a neck tube 14. The neck tube 14 connects the open neck 15 of the inner vessel 13 to the open neck 16 of the outer shell 12 and defines an evacuable space 17 separating the outer shell 12 and the inner vessel 13. A neck tube core 18 is removably inserted into the neck tube 14 to reduce heat radiation losses through the neck tube 14 as well as to prevent foreign matter from entering into the inner vessel 13 and to preclude moisture vapors from building up highly objectionable frost and ice barriers inside the neck tube 14. The neck tube core 18 should fit loosely within the neck tube 14 to provide sufficient clearance space between the neck tube 14 and the neck tube core 18 for assuring open communication between the atmosphere and the inner vessel 13.

The evacuable space 17 is filled with insulation material 19 preferably composed of low emissivity radiation barriers, like aluminum foil, interleaved with low heat conducting spacers or metal coated nonmetallic flexible plastic sheets which can be used without spacers. Typical multilayer insulation systems are taught in U.S. Pat. Nos.: 3,009,600, 3,018,016, 3,265,236, and 4,055,268, the disclosures of which are all herein incorporated by reference. A plurality of frustoconical metal cones 20 may be placed around the neck tube 14 in a spaced apart relationship during the wrapping of the insulation in order to improve the overall heat exchange performance of the storage container 10 following the teaching of U.S. Pat. No. 3,341,052 the disclosure of which is herein incorporated by reference.

To achieve the required initial vacuum condition in the evacuable space 17, the air in the evacuable space 17 is pumped out through a conventional evacuation spud 21 using a conventional pumping system not shown. After the evacuation has been completed the spud 21 is hermetically sealed under vacuum in a manner well known in the art using, for example, a sealing plug and cap (not shown).

An adsorbent 22 is located in the vacuum space 17 to maintain a low absolute pressure of typically less then $1\times10^{-4}$ torr. The adsorbent 22 may be placed in a retainer 23 formed between the shoulder 24 and the neck 15 of the inner vessel 13. The retainer 23 has a sealable opening 25 through which the adsorbent 22 is inserted. The adsorbent 22 is typically an activated charcoal or a zeolite such as Linde 5A which is available from the Union Carbide Corporation. A hydrogen getter 26 such as palladium oxide (PdO) or silver zeolite may also be included in the vacuum space 17 for removing residual hydrogen molecules. To those skilled in the art it is apparent that other locations, as well as methods of placement of the adsorbent and the hydrogen getter, are feasible.

Figure 2:
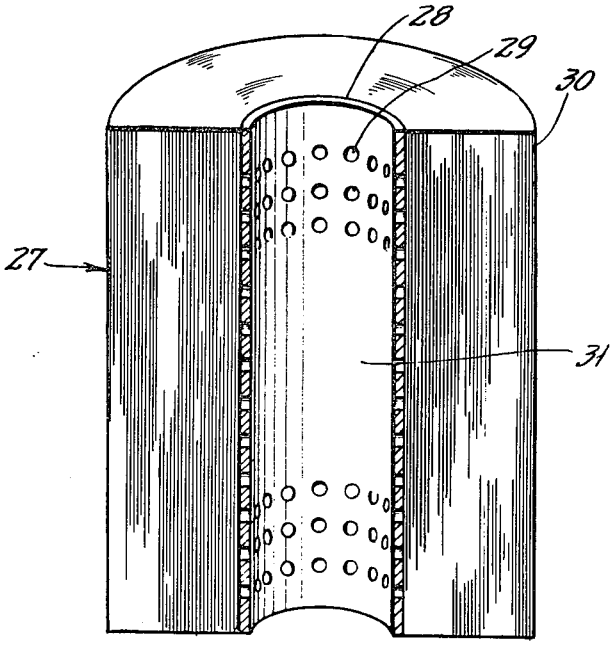
FIG. 2 is a perspective view of the nitrogen adsorption structure of FIG. 1 cut lengthwise in half.

The inner vessel 13 contains a micro-fibrous structure 27 for holding liquid nitrogen by adsorption and capillary suspension. The micro-fibrous structure 27, which is shown in partial perspective in FIG. 2, comprises a core 28 and a glass fiber matrix 30 composed of a continuous web of glass fibers surrounding the core 28 in the form of a coiled roll which is preferably cylindrical in configuration. Although one does not ordinarily associate glass with characteristics such as sponginess and porosity, it has been discovered in accordance with the present invention that reasonably compacted webs of glass fibers possess high capacity for holding liquid nitrogen by adsorption and capillary suspension provided the glass fibers in forming the web are of very small diameter and provided further that the adjacent web layers made of glass fibers, are coiled up into a roll with a reasonable degree of compactness between the aggregate layers of the roll. The coiled up roll was found to be preferred in constructing the micro fibrous structure 27 of this invention. However, to those skilled in the art it is apparent that an alternate micro-fibrous matrix configuration can be formed by cutting out a multiplicity of individual discs from a web of micro fiberglass, punching a hole in the center of each disk and stacking up the disks about the core into a relatively compact body having an external configuration as shown in FIG. 2. The liquid nitrogen is held in the coiled-up micro-fibrous matrix by molecular adsorption to the enormous aggregate area of the micro fibers, as well as by capillary suspension made possible by the microscopic intra-fibrous voids between individual fibers. It is therefore of importance that the diameters of the glass fibers be as small as possible with the preferred range from 0.03 to 8 microns.

The web of glass fibers should preferably be formed without using any ridgidizing binders or cements. Substantially binderless inorganic fiber webs are commercially available from e.g., the Dexter Corporation in Windsor Locks, Conn. under the present material description designation of Grade 233; from Manning Paper Company, Troy, N.Y., web 9# Manninglas 1000 with a mean glass fiber diameter of 0.63 micron; webs from Pallflex Products Corporation, Putnam, Conn., under the designation of Tissuglas 60A, Tissuglas 100A, and Tissuquartz. The example Grade 233 web of glass fibers used in this invention are composed of borosilicate glass with the glass fibers ranging from 0.5 to 0.75 microns in diameter. The non-woven web is made in a fashion similar to that used in the paper making process. The glass fibers are put into an aqueous suspension to form a mesh which is applied to a moving screen, dried out, compressed and compacted into a continuous web of glass fibers having a felt like consistency, wherein the strutural stability is effected primarily by intra-fibrous friction.

The core 28 is preferably of tubular geometry having a central void 31 into which the biological product is to be placed during shipment. The core 28 can be of any material composition, e.g., metal or plastic that will remain structurally stable and retain its form after being repeatedly subjected to cold shocks at liquid nitrogen temperatures. To maintain the lowest possible temperature within the cavity 31 the core 28 must be permeable to the nitrogen gas that boils off from the liquid nitrogen stored in the glass fiber matrix 30. The permeability of the core can be provided by forming the core 28 from a perforated sheet rolled into a tube or using a porous sintered tube without apparent holes. Where perforations are used, the holes 29 in the wall of the core 28 must be small enough to prevent any loose fiber particles from passing across the core wall 28 into the storage cavity 31 containing the biological product. Hole sizes of 1 millimeter in diameter have been found to be adequate for this purpose.

The matrix 30 is preferably formed by winding a continuous web of glass fibers around the core 28 under reasonably high tension to assure a sufficient degree of compactness between all of the layers in the finished roll. This is readily established by forming the matrix 30 with about 200 to 280 layers per radial inch of roll thickness. The outside diameter of the glass fiber web matrix 30 should conform to the inside diameter 11 of the inner vessel 13.

The storage container 10 of FIG. 1 is preferably assembled starting with an inner vessel 13 of a two piece construction having an upper cylindrical section 32 with an open end bottom 34 and a lower section 33. The micro-fibrous structure 27 is inserted into the upper section 32 through its open bottom 34 before the lower section 33 is attached. The upper section 32 is crimped around the open bottom 34 to facilitate attachment of the lower section 33. The two sections 32 and 33 of the inner vessel 13 may be joined by welding the mated ends around the crimped edge at the bottom 34 of the upper section 32 to form a unitary structure which encloses the micro-fibrous structure 27. The core 28 of the micro-fibrous structure 27 is substantially aligned with the open neck 15 of the inner vessel 13 and should be disposed in substantially coaxial alignment with the neck tube 14. The neck tube 14 can be joined to the open neck 15 of the inner vessel 13 and to the open neck 16 of the outer shell 12 by a variety of means, such means depending primarily on the materials of the two constituents of a particular joint.

The outer shell 12 is also of a two piece construction with an upper cylindrical section 35 and a lower bottom section 36. The inner vessel 13 is inserted into the upper section 35 before the two sections are joined to each other. Where a wrapped composite insulation system is used, the inner vessel is first wrapped with the layers of insulation preferably using the heat exchange cones 20 before the inner vessel 13 is inserted into the upper section 35. The adsorbent 22 and getter composition 26 may be added at this time. The upper section 35 may have a crimped end 37 to facilitate attachment of the lower section 36. The two sections 35 and 36 are then welded together to form a unitary structure. Instead of circumferential crimping as shown in 34 and 37 of FIG. 1 other means of alignment of mating cylindrical components can be used, e.g. butt welding with a back-up ring or tack welding in a jig.

Four prototypes, designated for identification purposes as 2DS units, were built under normal manufacturing conditions in accordance with the preceeding description.

The liquid capacity of the glass fiber web matrix was determined by the apparent volume of the matrix and its porosity. The design volume of the prototype matrix was 2,370 $cm^3$. The porosity of the fibrous adsorption medium of this invention was found experimentally to vary between 89.4% and 95.8%. The calculated mean value of the porosity was 92%. The mean liquid capacity of the prototype matrix was therefore: 2,370 $cm^3 \times 0.92 = 2{,}180\ cm^3$ or 2.18 liters.

This then was the design figure for the amount of liquid nitrogen to be held within the fibrous matrix by adsorption and capillarity without drainage or spillage. Actual test data showed these figures to be remarkably close.

In service, the liquid nitrogen, held in the matrix, keeps evaporating due to the unavoidable heat inflow from ambient resulting from the temperature gradient between ambient and liquid nitrogen. Eventually all the cryogen is bound to boil off completely, leaving the storage compartment for the temperature sensitive product without refrigeration. Considering this circumstance, which in essence is a race between the holding time of the storage container and the shipping time of the product, the rate of evaporation is the most important characteristic of a shipper-refrigerator.

The evaporation rates of the 4 prototypes of this invention ranged between 0.088 liter/day and 0.081 liter/day with a mean of 0.083 liter/day. This remarkably low evaporation rate makes it possible to achieve a mean holding time of $$\frac{2.18\ \text{liters}}{0.083\ \text{liter/day}} = 26\ \text{days}$$

compared to 5 days for state-of-the-art shippers.

To test the performance of the four 2DS prototypes they were filled to capacity with liquid nitrogen and left standing for a few days to cool down and to reach steady state condition in heat transfer. The necktube was closed with the loosely fitting necktube core 18, made of a low heat conducting foam composite. The core remained inside the necktube for the entire duration of the tests. The gaseous nitrogen, continuously boiling-off from the liquified gas, had always free passage to atmosphere through the clearance space between the outside of the loosely fitting core and the inside of the necktube. Following cooldown the 2DS prototypes were emptied of all the free flowing liquid nitrogen by turning them upside down. The units were left in "dry" condition. The only liquid nitrogen left in the inner container was that which had been adsorbed by the glass fiber web matrix.

After the nitrogen has been dumped, the weight of each unit was recorded. The difference in weight between the empty unit with core (which had been determined before the test) and the weight of the unit, emptied of all its free flowing nitrogen, determined the amount of liquid nitrogen adsorbed in the matrix. During the following 6 days the units were left undisturbed in the test room. Then the final weight of each unit was taken. The difference between the last two scale figures determined the amount of liquid nitrogen boiled off in 6 days from the adsorbed reserve in the matrix.

The performance of a cryogenic container can be expressed in terms of holding time or in terms of normal evaporation rate. Both are being used interchangeably. The normal evaporation rate (NER), expressed in any convenient mass or volume units of the cryogen per day, is determined by dividing the weight of the cryogen, evaporated within a reasonable number of days, by the said number of days. The relevant data of the tests are summarized in the following Table I.

TABLE I

| | 2DS Prototype Number | | | | |
|---|---|---|---|---|---|
| Data Identification | 1 | 2 | 3 | 4 | Mean |
| Wt gms of empty 2DS (Plus necktube core) | 2910 | 2910 | 2915 | 2906 | 2910 |
| Wt gms of 2DS with adsorbed nitrogen | 4672 | 4672 | 4672 | 4676 | 4673 |
| Wt gms of adsorbed liquid nitrogen only | 1762 | 1762 | 1757 | 1770 | 1763 |
| Vol lts of adsorbed liquid nitrogen only | 2.18 | 2.18 | 2.174 | 2.19 | 2.18 |
| Wt. gms of 2DS after 6 days of NER testing | 4245 | 4268 | 4281 | 4281 | 4269 |
| Wt gms of evaporated nitrogen in 6 days | 427 | 404 | 391 | 395 | 404 |
| Vol lts of evaporated nitrogen in 6 days | 0.528 | 0.5 | 0.484 | 0.489 | 0.5 |
| Mean NER of 2DS in liters/day | 0.088 | 0.083 | 0.081 | 0.082 | 0.083 |
| Number of days of projected holding time | 24.77 | 26.26 | 26.84 | 26.71 | 26.14 |

A test was conducted to establish the absorption rate and filling time of a micro-fibrous structure for use in a typical storage container, with the micro-fibrous structure having the following specification:

| | |
|---|---|
| Diameter of core (perforated stainless steel) | 4.57 cm |
| Diameter of rolled Dexter Grade 233 glass fiber matrix | 14.27 cm |
| Height (from bottom to top of matrix) | 17 cm |
| Volume of matrix exclusive of core | 2440 $cm^3$ |
| Weight of empty structure (matrix and core) | 1.159 lb. |
| Weight of the structure saturated with liquid nitrogen (two hours after being submerged in liquid nitrogen) | 5.320 lb. |
| Weight of liquid nitrogen adsorbed in two hours | 4.161 lb. |
| Liquid nitrogen saturated structure | 5.320 lb. |

-continued

| | |
|---|---|
| reweighed after 3 hours | |
| Liquid nitrogen saturated structure reweighed after 4 hours | 5.320 lb. |
| Fill time for matrix | 2 hrs. |
| Porosity of matrix | 95.8% |

The invention as described in accordance with the preferred embodiment should not be construed as limited to a specific configuration for the core and adsorption matrix in defining the micro-fibrous structure. For example the core may have a plurality of voids defined, for example, within a tubular framework with the voids separated by partitions extending from a solid control post to the outer tubular wall of the core. In such case only the outer tubular wall of the core must be permeable to gaseous nitrogen.

I claim:

1. An open-to-atmosphere storage container for transporting materials at cryogenic temperatures having a micro-fibrous structure adapted for holding a liquified gas such as liquid nitrogen in adsorption and capillary suspension within the interior of the container, said micro-fibrous structure comprising a core permeable to gaseous and/or to liquid nitrogen, with said core being centrally disposed in said container and having at least one void adapted for the removable placement of the transportable materials; and a liquified gas adsorption matrix composed of a web of very small diameter inorganic fibers surrounding said core in a multilayered arrangement having an outside diameter conforming to the inside diameter of the storage container.

2. An open-to-atmosphere storage container as claimed in claim 1 further comprising an inner vessel containing said micro-fibrous structure, said inner vessel having an end open to the atmosphere, an outer shell surrounding said inner vessel and spaced apart therefrom to define an evacuable space therebetween for forming a vacuum upon being evacuated, insulation material occupying said evacuable space and means for sealing the evacuated space between the outer shell and the inner vessel.

3. A storage container as claimed in claim 2 further comprising a neck tube extending between the open end of the inner vessel and the outer shell, said neck tube being open to the atmosphere, and a neck tube core loosely fitting within the open neck tube for assuring open communication between the atmosphere and the inner vessel.

4. An open to atmosphere storage container as claimed in claim 3 wherein said insulation material is composite multilayered insulation composed of a radiant heat reflecting component and a low heat conducting component disposed in relation to the radiant heat reflecting component so as to minimize the transfer of heat across evacuable space.

5. An open to atmosphere storage container as claimed in claim 2 wherein said insulation material consists essentially of finely divided particles of agglomerate sizes, less than about 420 microns, of low heat conducting substances such as perlite, alumina, and magnesia, with or without admixture of finely divided radiant heat reflecting bodies having reflecting metallic surfaces of sizes less than about 500 microns.

6. A storage container as claimed in claims 1, 3, or 4 wherein said multi-layered structure surrounding said core is in the form of a coiled roll or cylindrical shape having multiple layers of said inorganic fiber web in relatively compact engagement with one another.

7. A storage container as claimed in claim 6 wherein the diameter of said inorganic fibers range between 0.03 to 8 microns.

8. A storage container as defined in claim 7 wherein said inorganic fibers are composed of borosilicate glass.

9. A storage container as defined in claim 7 wherein said inorganic fibers are composed of quartz.

10. An open to atmosphere storage container as claimed in claim 8 wherein said core is of a hollow tubular construction with said void defined by the hollow space in said core.

11. A storage container as defined in claim 10 wherein said core has a multiple number of small perforated openings of a suitable geometric configuration and size.

12. A storage container as defined in claim 10 wherein said core is of an intrinsically permeable structure having inherent micro-passages throughout its body.

13. A storage container for shipping transportable materials at cryogenic temperatures comprising:

an inner vessel having an open end; an outer shell having an open end; access means connecting said open end of said outer shell to said open end of said inner vessel such that said inner vessel is suspended from said outer shell in a spaced apart relationship for defining an evacuable space therebetween; insulation means disposed within said evacuable space; and a micro-fibrous structure located within said inner vessel for holding liquid nitrogen by adsorption and capillary suspension, said micro-fibrous structure comprising a gas permeable core having a void disposed in said inner vessel in alignment with said access means, with said access means providing ingress and egress to said void for removably inserting said transportable materials and a liquid nitrogen adsorption matrix composed of a web of very small diameter inorganic fibers surrounding said core in a multi-layered arrangement with an outside diameter conforming to the inside diameter of said inner vessel.

14. A storage container as defined in claim 13 wherein said multi-layered arrangement is in the form of a coiled roll.

15. A storage container as defined in claim 13 wherein said multi-layered arrangement is a stack of superimposed disks with each disk formed from said web.

* * * * *